United States Patent [19]

Ladisch

[11] 4,022,379

[45] May 10, 1977

[54] PROCESS FOR REACTING ACID AND BASE

[75] Inventor: Gerhard Ladisch, Constance, Germany

[73] Assignee: Otto Pfrengle, Germany

[22] Filed: Oct. 16, 1975

[21] Appl. No.: 622,965

Related U.S. Application Data

[62] Division of Ser. No. 468,910, May 10, 1974, Pat. No. 3,929,291.

[52] U.S. Cl. ..... 239/8; 239/424; 252/188.3 R

[51] Int. Cl.[2] ..... B05B 7/00

[58] Field of Search ..... 239/8, 11, 422, 424, 239/425, 433, 1; 252/188.3 R, 359

[56] References Cited

UNITED STATES PATENTS

| | | | |
|---|---|---|---|
| 1,995,934 | 3/1935 | Mangold | 239/422 X |
| 2,631,983 | 3/1953 | Milliken, Jr. | 252/317 X |
| 3,773,262 | 11/1973 | Sparling | 239/424 X |

*Primary Examiner*—Evon C. Blunk
*Assistant Examiner*—Michael Mar
*Attorney, Agent, or Firm*—Marn & Jangarathis

[57] ABSTRACT

Process for reacting acid and base by use of a spray mixing nozzle having a central pressurized gas channel, at least two surrounding annular channels for acid and base and an outer annular channel for pressurized gas. The pressurized gas forcefully unites the acid and base into a spray at the nozzle outlet, and the acid and base react in the spray.

5 Claims, 3 Drawing Figures

7
11
5
6
8
10
9
4
3
2
1
2
3
4

PROCESS FOR REACTING ACID AND BASE

This is a division, of application Ser. No. 468,910, filed May 10, 1974 now U.S. Pat. No. 3,929,291.

The present invention relates to a spray mixing nozzle, and more particularly to a nozzle for spray mixing two liquids. Still more particularly, the present invention is directed to a spray mixing nozzle for uniting basic and acidic reacting liquids.

In British patent specification No. 1,188,582, there is described a spray mixing nozzle for mixing of base and acid liquids immediately after spraying. The nozzle is provided with a center channel and two concentric annular channels. The inner channels are provided for the liquids and the outer channel for the pressure gas. Although this spray mixing nozzle eliminates the disadvantages associated with pre-mixing of the components, the nozzle has a low throughput capacity. Attempts to increase the throughput capacity of such nozzles have not been generally successful in that at throughput capacity in excess of 150 to 200 liters per hour the fineness of the spray and the degree of neutralization are rapidly lowered. Accordingly, desirable throughput capacities in the order of 300 liters per hour and more could not be achieved.

The principle object of subject invention is to provide a spray mixing nozzle which does not have the known disadvantages and which permits a high throughput capacity while maintaining a high degree of product uniformity.

In accordance with the present invention, there is provided a spray mixing nozzle for uniting two liquids, preferably an acid and a base, having a central channel or passage directed to the nozzle exit for pressurized gas, at least two annular channels or passages, surrounding the central channel, for the liquids to be mixed and an outer annular channel or passage for pressurized gas.

Due to the cooperation of the central gas pressure channel with the outer annular pressure gas channel, the two liquids are forcefully driven into each other, so that a thorough mixing occurs, even at a high liquid throughput capacity. In contrast to the known spray mixing nozzle, the neutralization ratio, as well as the fine dispersion of the spray are substantially improved.

It is possible to add a further annular channel for a third liquid, for example, for a second acid or a neutral liquid, so that three annular channels for the liquids are provided around the central pressure gas channel. In the case that three liquids are sprayed, it may be advantageous to provide a further pressure gas channel between the annular channels for the liquids, so as to intensify the spraying.

The ratio of the throughflow diameters for the pressure gas in the inner central pressure gas channel and in the outer annular pressure gas channel should preferably be in a ratio of from 1 : 3 to 1 : 10. In a provided spray capacity of about 1,000 liters per hour, especially favorable results are obtained if the central pressure gas channel has a cross-section of 0.067 $cm^2$ and the outer annular gas channel has a cross-section of 0.4 $cm^2$.

The exit orifice of the central pressure gas channel is advantageously moved up a few millimeters in front of the nozzle exit, so that the exit terminates at the spraying point for the liquid. Thereby, the effect of the inner gas supply is intensified. In a nozzle wherein the outer concentric pressure gas channel is in a cross-section of 18 mm, the inner central pressure gas channel extends about 6 mm beyond all the other gas, and liquid exits.

In a further advantageous construction of the invention the outer wall of the outer annular pressure gas channel tapers conically, at least in the area of the orifice, toward the nozzle, thus forming a guide for the pressure gas in direction of the central uniting point. For operating the spray mixing nozzle, any suitable gases which are under pressure may be used. Besides air, nitrogen and carbon dioxide, ammonia or water vapor are also suitable.

It is advantageous to adjust the gas pressure for the central pressure gas channel to the same level as the gas pressure for the outer annular pressure gas channel. Due to the preferable different throughflow cross diameter, the pressure gas amount for the inner pressure gas channel is substantially lower than for the outer pressure gas channel. With increasing gas pressure, the fineness of the spray increases to a certain degree and also the completeness of the neutralization. For operational reasons gas pressures in the range of 4 to 5 aut (atmospheric excess pressure) are generally employed. However, higher gas pressures may be advantageously used. If it is intended to obtain an evaporation of the liquid, together with the spraying process, and if the neutralization heat is not sufficient for evaporation of the liquid, it is recommended to preheat the pressure gas.

When spraying highly concentrated acids (for example 98% sulfuric acid) with concentrated (for example 50%) alkali solution, a crust may form at the nozzle orifice during spraying, whereby the spraying becomes irregular. In this case, the nozzle orifice must be cleaned. This crust forming can be somewhat lessened if streams of water are passed through separate channels in the nozzle positioned outwardly from the outer pressure gas channel, with the water streams exiting at the tip of the nozzle and being inwardly directed. The problem of crusting, however, can be more effectively solved by the use of a thin stream of water directed against the spray mixing nozzle in the area of the orifice of the jet nozzle. The stream of water is directed obliquely from the front against either the front face of the nozzle, at the outer portion thereof; i.e., the nozzle orifice; the side portion of the nozzle which surrounds the outer pressure gas channel or the outer edge formed by the front and side faces. The best results are achieved by directing the water stream against the nozzle orifice. If need be, two such additional nozzles mounted at various sides may be used. The additional nozzle may consist of a capillary glass-, or plastic pipe. However, preferably, the material for the discharge nozzle should be of one material which should be metal having a bore of from 0.1 to 1.5 mm. This nozzle is connected to a water pipe which is under normal pressure. Preferred are bores between 0.3 and 0.8 mm. During an uninterrupted operation a 0.3 mm nozzle sprays about 1.81 l/h at a pipe pressure of 3 atu (atmospheric excess pressure) 3.1 l/h, at a 6 atu (atmospheric excess pressure). A 0.8 mm nozzle sprays about 15 l/h, at 3 atu (atmospheric excess pressure), and 21 l/h (hectoliters), at 6 atu (atmospheric excess pressure). These water throughput capacities are in a maximum amount of 2.1% when using a 0.8mm bore, and a throughput capacity of the spray mixing nozzle of 1,000 l/h (acid and lye solution) so that no meaningful dilution effect occurs. For simplification purposes, the water spray nozzle can be maintained at constant operation. The stream of water has a cooling effect on the one hand and removes the crust on the other hand, whereby the kinetic energy of the water stream plays an important role. It is even more favorable to operate the nozzle in intervals, for example, every 20 seconds for 5 seconds. In this manner water may be saved or at the same water consumption ratio a nozzle with a larger bore may be used, for example, lmm, so that momentarily more water is available for removing the crust.

The water nozzle or nozzles, including the supply lines, are preferably mounted as a unitary structure with the body of the spray mixing nozzle. The unitary construction is particularly advantageous in that when installing or exchanging the nozzle, no adjustment is necessary and the stream of water is always in the optimum direction.

In accordance with the particularly preferred embodiment wherein the stream of water is directed against the nozzle orifice, the water nozzle or nozzles are mounted close to the exit orifice of the spray mixing nozzle; i.e., the tip of the water nozzle is preferably mounted from 5 to 50 cm. away from the orifice of the spray mixing nozzle. Preferably, the water nozzle should be directed in front of the spray mixing nozzle and obliquely to the outer ranges of the nozzle orifice, that is, in particular to the portion of the nozzle orifice at which the pressurized gas exits from the outer annular channel. Preferably, the water nozzle should be mounted exchangeably, so that the force of the water stream may be adjusted as required. The water stream of the water nozzle should only be adjusted to a force as required for removing the crust, so as to avoid an undesirable dilution of concentrated acids and lyes during a spray mixing.

The inventive spray mixing nozzle may be advantageously used in spray towers for making a powder like product or in spray mixing drums for charging the spray product into a substrate which runs through the drums.

The invention will now be described in more detail in the following examples and with respect to the drawings.

Figure 1:
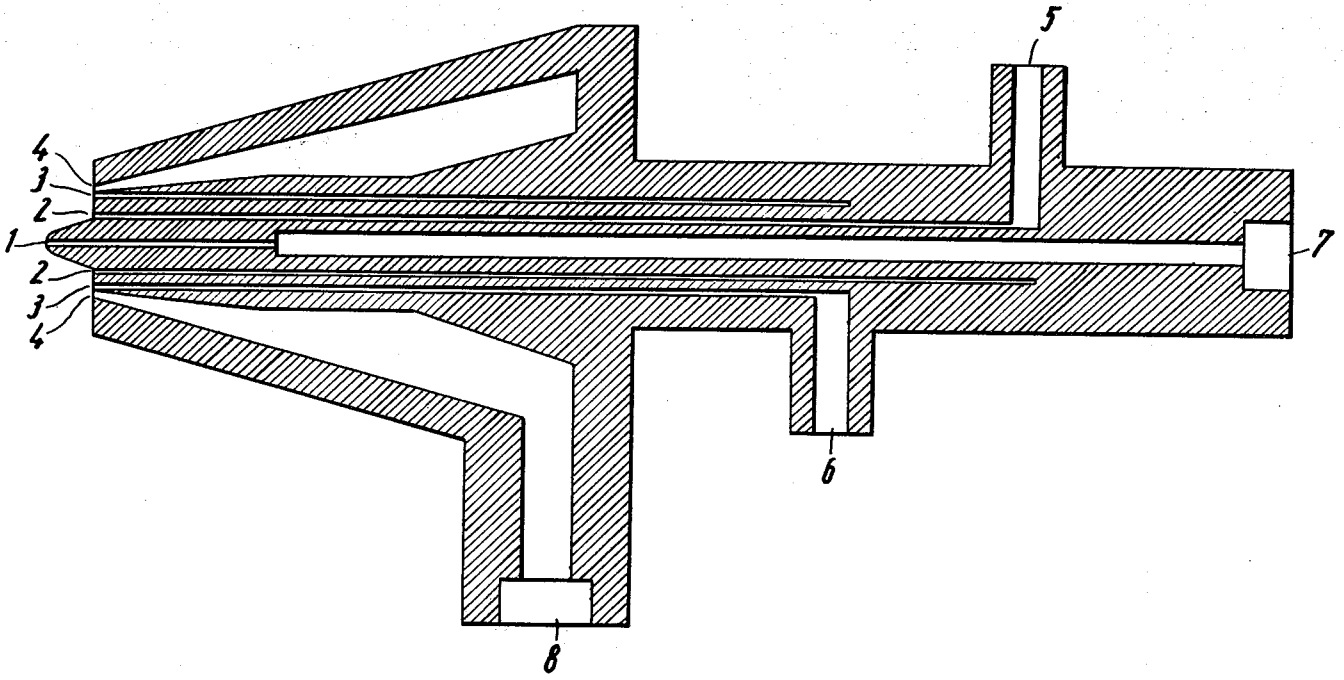
FIG. 1 shows a longitudinal cross-section through an embodiment of the spray mixing nozzle of the present invention.

Referring to FIG. 1, the spray mixing nozzle is comprised of a central pressure gas channel 1, two concentric annular channels 2 and 3 for the basic-, and acid reacting liquids and an outer concentric annular pressure gas channel 4 for mixing two different liquids. The liquids are introduced through charging pipes 5 and 6. The pressure gas is supplied through feed pipes 7 and 8. The outer wall of the outer pressure gas channel 4 is conical, so that the gas flows in direction of the central uniting point. The inner pressure gas channel 1 extends slightly beyond the other channels 2, 3 and 4. The pressurized gas from channels 1 and 4 forcefully mix the liquids from channels 2 and 3 in a spray at the nozzle outlet.

Figure 2:
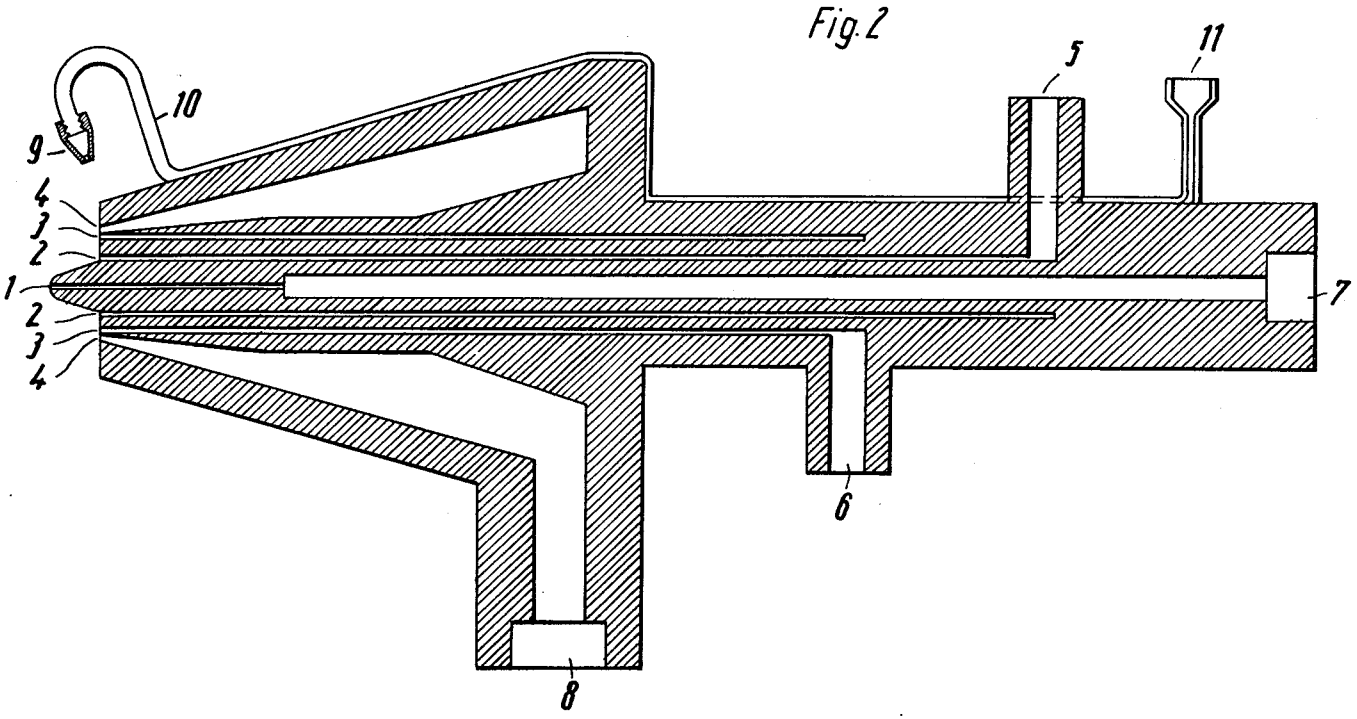
FIG. 2 is a cross-sectional view of another embodiment of the spray mixing nozzle of the present invention.

Referring to FIG. 2, there is shown a mixing spray nozzle as illustrated in FIG. 1 with the further addition of a nozzle 9 which is screwed onto a thin metal pipe 10. The additional nozzle 9 has a bore of 0.1 to 1.5mm. Metal pipe 10 is pressed flat at the section along the spray mixing nozzle, so that it fits snugly into a parallel groove provided in the outer wall of the nozzle. A feeding pipe 11 is provided to be connected to a water pipe. Pipe 10 and the groove are provided at one side of the nozzle, so as to not cross feeding pipes 5, 6 and 8. As shown, the nozzle 9 is directed against the front outer edge of the spray mixing nozzle and as hereinabove described, functions to reduce the formation of crust.

Figure 3:
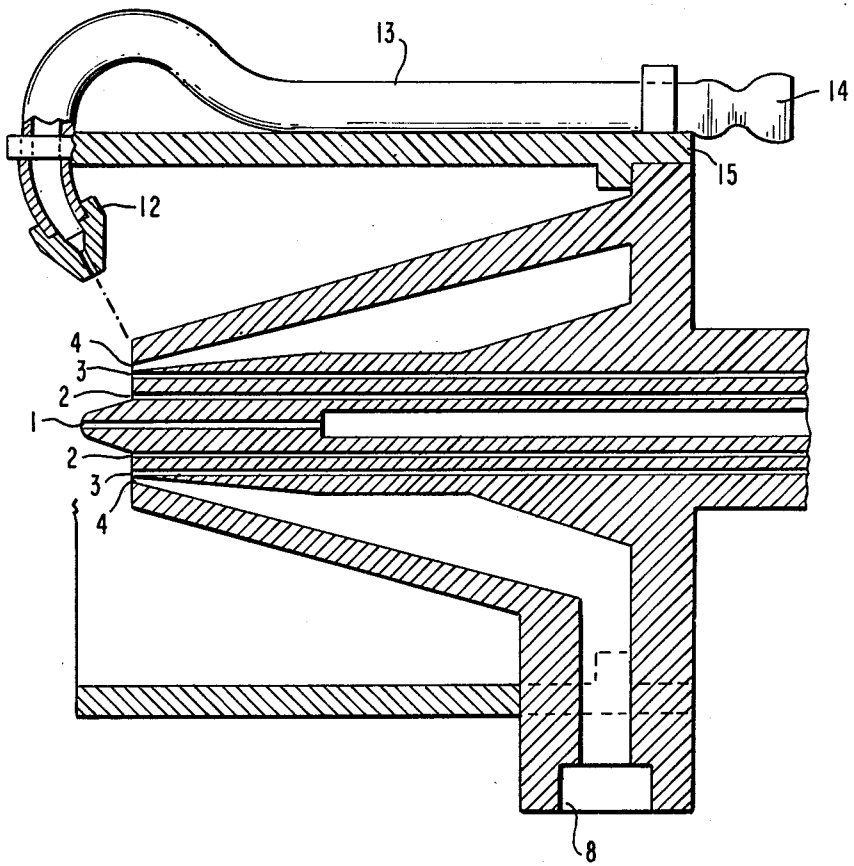
FIG.3 is a cross-sectional view of a further embodiment of the spray mixing nozzle of the present invention.

Referring to FIG. 3, there is shown a further embodiment of a spray mixing nozzle, as illustrated in FIG. 1, with the further addition of a nozzle 12, for reducing and/or eliminating the formation of crust, which is positioned to direct a thin stream of water toward the orifice of the spray mixing nozzle; in particular, against the front face of the nozzle in the area of the outlet for the outer pressure gas channel 4. The spray mixing nozzle is provided with an outer cylinder 15 which represents an extension of the outer circumference of the spray mixing nozzle. The cylinder 15 extends beyond the orifice of the spray mixing nozzle, and the supply line 13 for the water nozzle 12 extends through the cylinder 15 and is integral therewith. The cylinder 15 functions to protect the spray mixing nozzle against mechanical damage. Water is provided through line 14.

The use of the embodiments of FIGS. 2 and 3, particularly FIG. 3, is particularly advantageous when spraying highly concentrated acids, for instance, sulfuric acid or alkyl phenyl sulfonic acid, with a concentrated base, such as, 50% sodium hydroxide. In effecting spraying of acid and base into a hot space, for example, into a spray drier, in many cases, the water nozzle is required to prevent detrimental crust formation.

The present invention will be described with respect to the following examples, but the scope of the invention will not be limited thereby.

EXAMPLE I

For proving the quality of the spray mixture product and to prove the capacity of the inventive spray mixture nozzle we sprayed vertically downwardly a distance of 120cm. This distance corresponds to a medium distance of the spray mixing nozzle from a substrate in large spray mixing installations.

In a distance of about 120cmm. away from the spray mixing nozzle a board was moved parallel with respect to the floor, so that the stream of spray hit the board for only a fraction of a second. The board was provided with a filter paper of the hard type. A liquid path created by the spray mixing nozzle could be seen on the filter paper. However, at the edges of this path the individual drops could be clearly seen.

The test solution consisted of a red colored solution which was colored with rhodamine B of 250 g cellulose glycolate-gelatine in 10 l of water.

The second test solution contained a methyl blue colored solution with 50 g gelatine to 10 l water.

First of all the inventive spray mixing nozzle of FIG. 1 was tested. By spraying of about 500 l/h of red solution and 100 l/h of blue solution at 4 atu (atmospheric excess pressure) a complete flawless spray was obtained as was shown by the uniform violet mixed color of the drops as shown on the filter paper. At 3 atu (atmospheric excessive pressure) the result was still satisfactory.

By using 1000 l/h red solution and 200 l/h blue solution, the result considering the practice, was still satisfactory at 4 atu. The spray was sufficiently fine and the largest amount of the droplets were colored violet. However, at 5 atu on the inner and outer pressure gas pipe the result was much better.

A comparison with the spray mixing nozzle according to British Pat. No. 1,188,582 showed the following results: With a throughput capacity of 150 l/h red solution and 30 l/h blue solution at a pressure of 4 atu, a sufficient result was obtained. The droplets were fine and showed predominantly a violet color. With a throughput capacity of 200 l/h of red solution and 40 l/h of blue solution, the result was already bad. A plurality of drops showed a red or blue coloration. At a throughout capacity of 300 l/h of red solution and 60 l/h of blue solution the result was completely unsatisfactory.

EXAMPLE 2

The spraying tool place in a closed room, that is from the front face into the inside of a double conical spray drum (corresponding to German Pat. No. 1,797,064). The spray mix drum had a length of 240cm. and a maximum cross diameter of 180 cm. At the opposite front face a vacuum device of high capacity was provided.

In the charge opening of the drum a guide for a rod was provided, whereby the end of the rod changed into a kind of a round blade which was covered with filter paper on one side. When moving this blade into the spray mixing drum, the distance to the spray mixing nozzle was about 120cm. Before the test, the filter paper was impregnated with an alcohol solution of naphtholphthaline as an indicator and dried. The resulting color showed whether the droplets were alkaline, acid or neutral in their reaction, thus indicating how thorough the mixture was.

For spraying, high concentrated alkyl phenylesulfonic acid of 50° C was used as the first liquid, and sodium hydroxide solution was used as the second liquid. First of all the rod with the associated blade was introduced into the drum, whereby the filter paper was on the side away from the spray mixing nozzle. The rod was then turned very suddenly by 360°, so that during the turning movement, the filter paper was exposed to the stream of spray for a very short time. Subsequently, the rod was removed from the drum immediately and the spraying terminated.

By using the spray mixing nozzle according to FIG. 1, 500 l/h alkyl phenyl sulfonic acid and b 100 l/h of sodium hydroxide solution were finely sprayed under a pressure of 4 atu in the inner and outer pressure gas channel. The neutralization was flawless. When using 1000 l/h alkyl phenyl sulfonic acid and 200 l/h sodium hydroxide solution, the result was still satisfactory at 4 atu. The coloration of the filter paper showed that only very few very fine acid droplets appeared. The neutralization was complete and the drop uniformity satisfactory. When using the spray mixing nozzle according to British Pat. No. 1,188,582 (three channel nozzle) showed a good result at 4 atu and 150 l/h phenyl sulfonic acid and 30 l/h of sodium hydroxide solution. The spray was fine and the neutralization was satisfactory. However, the spray quality was noticeably less when using 200 l/h acid and 40 l/h lye. When using 300 l/h acid and 60 l/h lye the neutralization as well as the spray was completely unsatisfactory. Many large acid droplets were present on the filtering paper.

When using the inventive spray mixing nozzle a neutralization-mixing spray can be flawlessly obtained up to a throughput capacity of 1,000 l/h acid and the required quantity of base for the neutralization. Hence, the requirements for a practical use are met.

EXAMPLE 3

This example describes the use of the inventive spray mixing nozzle in connection with a mixing process in a one sided conical rotating spray mixing drum (according to German Pat. No. 2,006,503, FIG. 3). The large cross diameter of the spray chamber was 1.9mm and the length 2.3m. The rotational speed of the spray mixing drum was at 47 rotations per minute. Two basic detergent substances were mixed in quantities of 3.07 tons and 6.03 tons per hour.

From a commonly known binary nozzle 250 kg/h of an alkyl polyglycol ether was sprayed. Furthermore, with the spray mixing nozzle of FIG. 1 1,299 kg alkyl phenyl sulfonic acid ("AS3-acid") and 67.5kg/h 50% sodium hydroxide solution was sprayed.

In an after mixing chamber, which is switched in series with the spray chamber, 300 kg/h of magnesium silicate were continuously admixed. The total composition of the product is reflected in the following table.

A light trickling beautifully granulated product with a discharge density of 340 g/l was obtained.

| | Total Composition (in%) | | | | |
|---|---|---|---|---|---|
| Substance | Detergent base substance I | Detergent base substance II | Spray during spray mixing | After mixing chamber | Total % |
| $Na_5P_3O_{10}$ | 4.2 | 35.4+ | — | — | 39.8 |
| Na-perborate | — | 21.9 | — | — | 21.9 |
| Na-sulfate | 6.7 | — | — | — | 6.7 |
| Na-disilicate | 1.5 | 1.6++ | — | — | 3.1 |
| CMC | 0.9 | 1.2 | — | — | 2.1 |
| Mg-silicate | — | — | — | 3.0 | 3.0 |
| Water | 2.1 | — | 0.3 | — | 2.4+ |
| Soap | 7.65 | — | — | — | 7.65 |
| Alkylphenyl sulfonic acid | 7.65 | — | 3.2 | — | 10.85 |
| Nonionic | — | — | 2.5 | — | 2.5 |

Remarks:
+discharge density 300g/l
++Discharge density 80g/l
+The crystal water of the perborate is not calculated.

Numerous modifications and variations of the present invention are possible in light of the above teachings and, therefore, within the scope of the appended claims. The invention may be practiced otherwise than as particularly described.

What is claimed is:

1. A process for reacting an acid and a base, which comprises:

passing pressurized gas through a central channel of a spray mixing nozzle to the outlet orifice of the nozzle;

passing to the outlet orifice of the nozzle liquid acid through one and liquid base through a second of at least two annular channels which surround the central channel; and passing pressurized gas through an outer annular channel which surrounds the at least two annular channels to the outlet orifice of the nozzle, said pressurized gas from the central channel and the outer annular channel forcefully mixing the acid and base from the at least two annular channels in a spray at the nozzle outlet at a throughput capacity in excess of 150 to 200 liters per hour whereby the acid and base react in said spray to produce a salt.

2. The process of claim 1 wherein the acid is a concentrated acid and the base is a concentrated base.

3. The process of claim 2 wherein the acid is sulfuric acid.

4. The process of claim 2 wherein the acid is alkyl phenyl sulfonic acid.

5. The process of claim 2 wherein the base is sodium hydroxide.

* * * * *